US005828016A

United States Patent [19]

Grannan et al.

[11] Patent Number: 5,828,016

[45] Date of Patent: Oct. 27, 1998

[54] LOW PROFILE TACTILE SWITCH

[75] Inventors: Dennis A. Grannan, Williamsburg, Va.; David W. Thompson, Loveland, Colo.

[73] Assignee: Lucas Automation and Control Engineering, Inc., Hampton, Va.

[21] Appl. No.: 794,650

[22] Filed: Feb. 3, 1997

Related U.S. Application Data

[60] Provisional application No. 60/011,513 Feb. 12, 1996.

[51] Int. Cl.[6] ..... H01H 13/00

[52] U.S. Cl. ..... 200/16 R; 29/622; 200/5 A

[58] Field of Search ..... 200/1 R, 1 A, 200/5 R, 5 A, 17 R, 18, 512–517, 341, 520, 405, 406, 16 R–16 D; 29/622

[56] References Cited

U.S. PATENT DOCUMENTS

| | | | |
|---|---|---|---|
| 3,590,331 | 6/1971 | Kirsch | 317/112 |
| 3,643,041 | 2/1972 | Jackson | 200/5 A |
| 3,800,104 | 3/1974 | Lien et al. | 200/5 A |
| 4,056,701 | 11/1977 | Weber | 200/314 |
| 4,102,039 | 7/1978 | Henrickson et al. | 29/593 |
| 4,207,448 | 6/1980 | Furusawa et al. | 200/159 B |
| 4,331,851 | 5/1982 | Johnson | 200/159 B |
| 4,398,074 | 8/1983 | Danielson et al. | 200/302 |
| 4,412,113 | 10/1983 | Mitsugi et al. | 200/67 DB |
| 4,430,531 | 2/1984 | Wright | 200/5 A |
| 4,438,304 | 3/1984 | Kennedy | 200/67 D |
| 4,484,042 | 11/1984 | Matsui | 200/67 DB |
| 4,659,881 | 4/1987 | Dowe | 200/5 R |
| 4,695,681 | 9/1987 | Velleman | 200/5 A |
| 4,794,215 | 12/1988 | Sawada et al. | 200/159 B |
| 4,803,321 | 2/1989 | Lefebvre | 200/517 |
| 4,843,197 | 6/1989 | Kojima et al. | 200/406 |
| 4,987,278 | 1/1991 | Tsutsumi | 200/294 |
| 5,564,560 | 10/1996 | Minelli et al. | 200/516 |

FOREIGN PATENT DOCUMENTS

| | | | |
|---|---|---|---|
| 0692802 | 12/1996 | European Pat. Off. | H01H 13/48 |
| 2902357 | 7/1980 | Germany | H01H 13/70 |
| 7-288061 | 10/1995 | Japan | H01H 11/00 |
| 2205443 | 12/1988 | United Kingdom | H01H 1/58 |
| 8907328 | 8/1989 | WIPO | H01H 11/00 |

*Primary Examiner*—Michael A. Friedhofer
*Attorney, Agent, or Firm*—Lloyd L. Zickert

[57] ABSTRACT

A low profile tactile switch including a conductive member having a dome profile and lead means, a conductive contact member having a contact and lead means and an insulating member arranged between the conductive member and the contact member but allowing contact between the members upon actuation of the dome profile, wherein the switch may be mass produced from rolls of flat material.

38 Claims, 7 Drawing Sheets

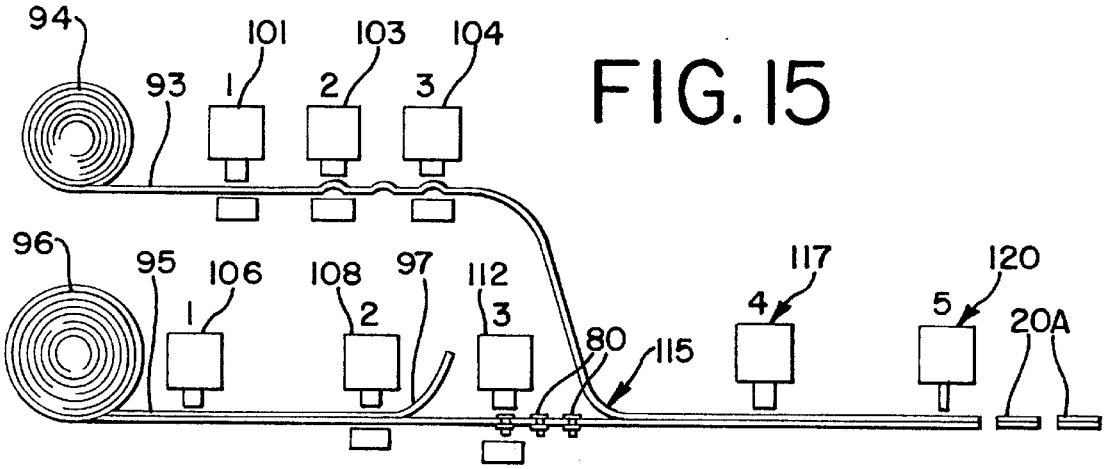
FIG. 15
FIG. 16
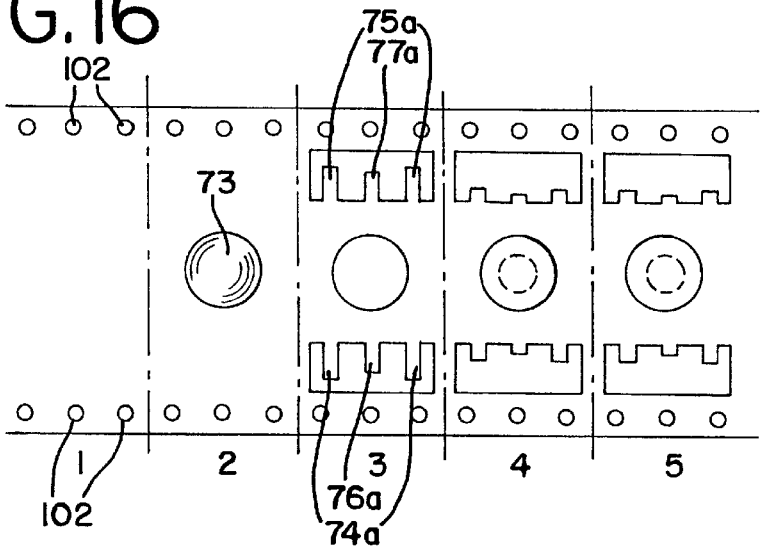
FIG. 17
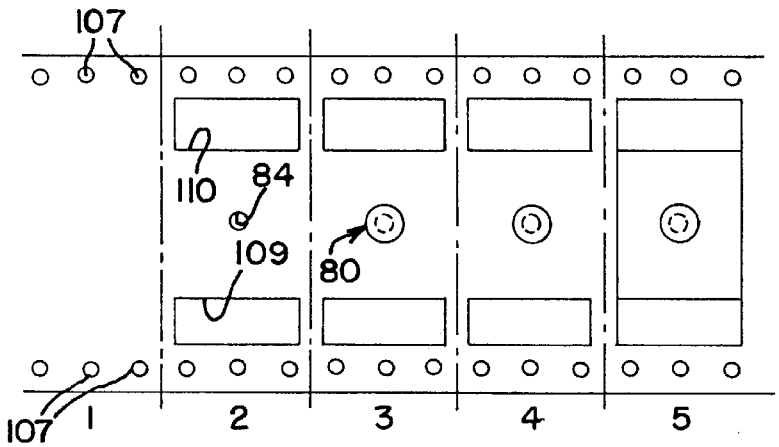

LOW PROFILE TACTILE SWITCH

DESCRIPTION

This application claims the benefit of U.S. provisional application Ser. No. 60/011,513, filed Feb. 12, 1996.

This invention relates in general to a low profile tactile switch and a method of economically making the switch where the switch is low in material content and includes a low profile, and which can be readily mass produced, and more particularly to a low profile tactile switch that can be mass produced from rolls of flat material.

BACKGROUND OF THE INVENTION

Heretofore, it has been known to provide tactile switches that include domes selectively movable to engage a contact for closing the switch. However, these switches have many parts, require complex assembly processes and are relatively costly to manufacture. Further, where sealed switches are involved, air is not allowed to escape from the space below the dome which generally causes the switch to feel spongy as the dome is pressed and the air under the dome is compressed. Thus, it is an objective to minimize sponginess in sealed switches.

Further, prior tactile switches could not be efficiently mass produced.

SUMMARY OF THE INVENTION

The low profile tactile switch of the present invention is lower in material content and with a lower profile than heretofore known switches, and can be more readily mass produced than prior switch designs. The switch of the present invention may be a sealed switch or an unsealed switch and can be applied to circuit boards with commercially available automatic insertion equipment. Further, the switch may be provided in single form, or in array form where several switches are provided for single or multiple circuits. Also, the switch of the present invention may be mass produced from rolls of flat material and by using known punch press technology or other known forming technology in order to provide a reliable switch that is less costly than heretofore marketed switches.

In one embodiment of the invention, the switch is constructed from two rolls or reels of flat web or strip material that may be stainless steel or any suitable high electrically conductive material for switch contacts and particularly for use in a tactile switch having a dome contact. However, it should be appreciated that any suitable conductive material may be provided for the switch contacts including but not limited to beryllium copper alloys. The web or strip of one of the rolls of steel or conductive material is incrementally fed through a punch press to form successive dome profiles and lead or terminal profiles in the strip. The dome profile functions as one contact and defines a depressible member that upon being depressed moves overcenter to engage a stationary contact but will return upon removal of the depressing force, thereby defining a tactile response. The other web of steel is incrementally fed through a punch press to be suitably formed to compliment the dome strip, and sometimes to form a smaller non-depressible dome or dimple defining a raised contact member or profile to be contacted by the dome. Alternatively, the other web may be plain without a smaller dome or dimple. A suitable electrical insulator to be sandwiched between the two metal strips is incrementally fed through a punch press from a roll of flat web or strip material so that successive openings or cutouts can be formed in the strip for alignment with the dome profile and the contact member. It should be appreciated that the cutouts may be formed by other methods such as by laser cutting. This insulating material may be of any suitable type that is preferably non-extendable and includes a polymer film such as a polyester or a polyimide plastic. Pressure-sensitive adhesive is laminated to both sides of the insulator which automatically adheres to the steel strip with the dome profile and the steel strip with the stationary contact profile, wherein the contact profile may extend into and substantially through the opening of the insulator. Thus, the two strips of steel are mechanically held together by the adhesive. Additionally, pressure-sensitive adhesive alone or pad-printed adhesives may serve as an insulator and also adhesively hold the steel strips together. Lead means are also formed in the strips of steel so that a lead or leads go to the dome profile and a lead or leads go to the contact profile that may be suitably connected to conductors in a circuit such as by soldering.

The tactile response of the switch is provided by the dome profile in the top half of the switch wherein when the dome is depressed it snaps over to engage the contact member and close the switch and when released will return to its original shape and provide a tactile response.

By controlling the size of the cutout or opening in the insulating layer and the thickness thereof and the size of the contact profile in a sealed switch, the air displaced by the snap-over of the dome can be very small with respect to the total volume of air trapped between the dome profile and the contact profile to thereby render any sponginess during operation to feel negligible.

In another embodiment of the invention, a roll or reel of flat steel is incrementally fed to a punch press to form the upper part of the switch with a dome profile. A roll of insulating material having a pressure-sensitive adhesive layer on one surface is also incrementally fed to a punch press for forming openings or cutouts in the strip. As above mentioned, the cutouts may be formed by other methods. A preformed contact member in the form of a pin having lead means is then mounted in the insulating strip at the formed openings or cutouts and the strip is thereafter joined with the metal strip so that the dome profile of the metal strip is in alignment with the contact member. Lead means are formed on the upper strip, and ultimately the strip is cut into individual units for switches.

The switch of the present invention may also be provided in an array, such as including a plurality of spaced apart switches having common contacts for operating a single circuit, or separated contacts for operating and controlling multiple circuits. The arrays would be made by the same method where strips of metal and insulator would be processed to economically mass-produce the arrays.

The present invention may be easily and inexpensively manufactured wherein reels of raw material can be continuously fed in at one end of the switch-making operation with the finished product coming out of the other end of the operation to eliminate typical handling, forming or processing of individual piece parts.

It is therefore an object of the present invention to provide a new and improved low profile tactile switch in single or array form that is low in material content and has a low profile while maintaining the benefits of a tactile switch, and further which can be mass produced from reels of raw material.

Another object of the present invention is to provide a method of mass-producing a low profile tactile switch in single or array form that is low in cost.

Other objects, features and advantages of the invention will be apparent from the following detailed disclosure, taken in conjunction with the accompanying sheets of drawings, wherein like reference numerals refer to like parts.

DESCRIPTION OF THE DRAWINGS

FIG. 15 is a diagrammatic view of the machine line for mass producing the switch of FIGS. 12 to 14;

FIG. 16 is a top plan layout of the upper metal strip or web and showing sequentially the operating steps taken in the manufacture of the switch of FIGS. 12 to 14;

FIG. 17 is a top plan view of the insulating material strip and illustrating sequentially the strips taken for making the switch including the joining of the insulator strip with the metal strip;

DESCRIPTION OF THE INVENTION

Figure 1:
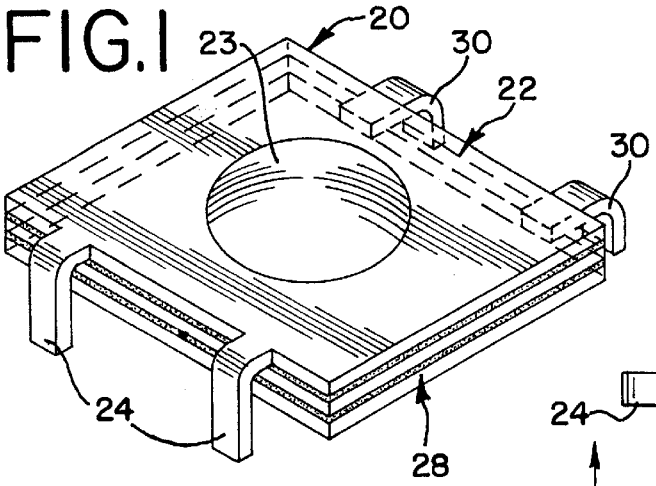
FIG. 1 is a perspective view of a low profile tactile switch according to the present invention.
Figure 2:
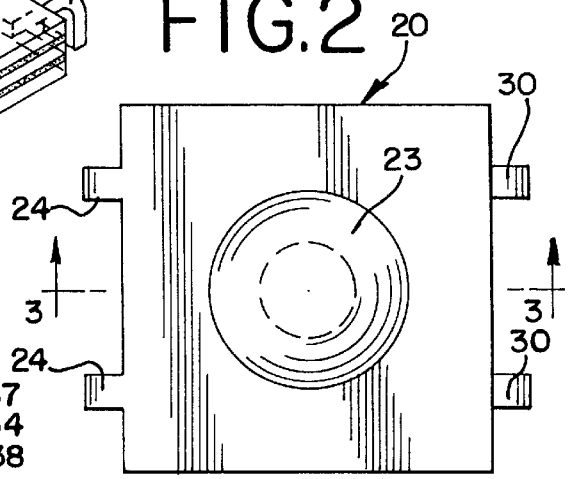
FIG. 2 is atop plan view of the switch of FIG. 1.
Figure 3:
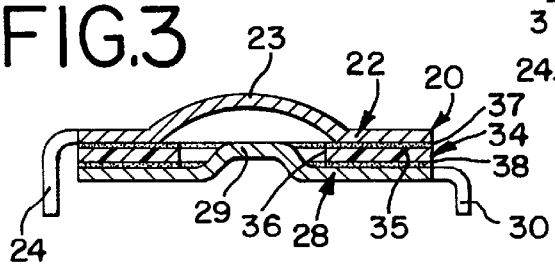
FIG. 3 is a transverse sectional view of the switch taken substantially along line 3—3 of FIG. 2.

Referring now to the drawings, and particularly to FIGS. 1 to 3, one embodiment of the low profile tactile switch of the present invention is generally indicated by the numeral 20 and includes an upper conductive member 22 having a dome profile 23 and lead means including a pair of leads 24, a lower conductive member 28 having a contact profile 29 and lead means including a pair of leads 30, and an insulator 34 including a polymer film of insulating material 35 having a cutout or opening 36, an upper pressure-sensitive adhesive layer 37 on the upper surface of the film and a lower pressure-sensitive adhesive layer 38 on the lower side of the film 35. Alternatively, the insulator 34 may be a layer of pressure-sensitive adhesive or a pad-printed adhesive. The upper conductive member 22 forms the upper half of the circuit, while the lower conductive member 28 forms the other half of the circuit, wherein the respective leads 24 and 30 are suitably connected into a circuit for which the switch 20 can function to close the circuit upon depressing the dome 23 overcenter to snap and engage the contact 29. The pressure-sensitive adhesive layers on the insulating film mechanically interconnect with the upper and lower conductive members to maintain the parts in assembled relation. As illustrated, the lower contact member is in the form of a hat-shaped dome that is smaller than the dome 23. Where the switch is sealed, by controlling the size of the film cutout 36 and the diameter of the contact dome 29, the air displaced by the snapover of the dome is very small in relation to the total volume of air in the trapped area such that the sponginess defined by the compressing of the air within the space between the upper and lower conductive members will feel negligible. The formation of the dome contact 29 is such that the dome 23 cannot attain a bi-stable condition and therefore will snap back to its original form upon release of pressure to the dome and produce a tactile response. Preferably, the contact dome 29 protrudes into the cutout of the insulating film or through the cutout to provide a stop for the dome 23 as it snaps over into engagement with the contact dome 29.

The upper and lower conductive members may be made from stainless steel, beryllium copper alloy, or any other suitable highly conductive material. The insulating film may be made of a suitable polyester or polyimide plastic film or a suitable pressure-sensitive adhesive. One form of a polyester film that would be suitable would be a Mylar film. One form of polyimide film may be a Kapton film. Mylar and Kapton are trademarks of DuPont Corporation. Another form of polyimide film would be a Permacel tape. Permacel is a trademark of Johnson & Johnson, Inc. The insulating film may have a thickness of about two to seven mils (0.05 mm to 0.18 mm) and preferably about 0.0025 inch (0.06 mm). The upper conductive member may have a thickness of about 0.002 to 0.010 inch (0.05 mm to 0.25 mm) and preferably may be of about 0.0025 inch (0.06 mm), it being understood that the thickness and material must be compatible with the operation of a dome to snap overcenter to make contact with opposed contact and return to home position and provide a tactile feel. The diameter of the dome profile may be from about 0.25 to 0.50 inch (6.4 mm to 12.7 mm). The lower conductive member may have a thickness of about 0.002 to 0.020 inch (0.05 mm to 0.5 mm) and preferably of about 0.00275 inch (0.07 mm). Where the switch is made of a 0.0025 inch (0.06 mm) thick upper member, a 0.0025 inch (0.06 mm) thick film, and a 0.00275 inch (0.07 mm) thick lower member, the total thickness of the main body of the switch, excluding the height of the dome profile and the thickness of the adhesive layers, is only about 0.00775 inch (0.2 mm).

It will be appreciated that a polyimide film as the insulating material between the upper and lower conductive members, while being more expensive than a polyester film, will resist high temperatures such as to facilitate wave soldering of the switch leads to a circuit board.

The adhesive layers for the insulating material may be of any suitable type that would constitute a high performance pressure-sensitive adhesive or any acrylic pressure-sensitive adhesive. Preferably, the adhesive would be able to stand wave solder temperatures for at least a few seconds and also have the ability to withstand storage temperatures of about −40° C. to 105° C. Further, it should be appreciated that the insulating film may be of other suitable plastics such as a polycarbonate.

Figure 4:
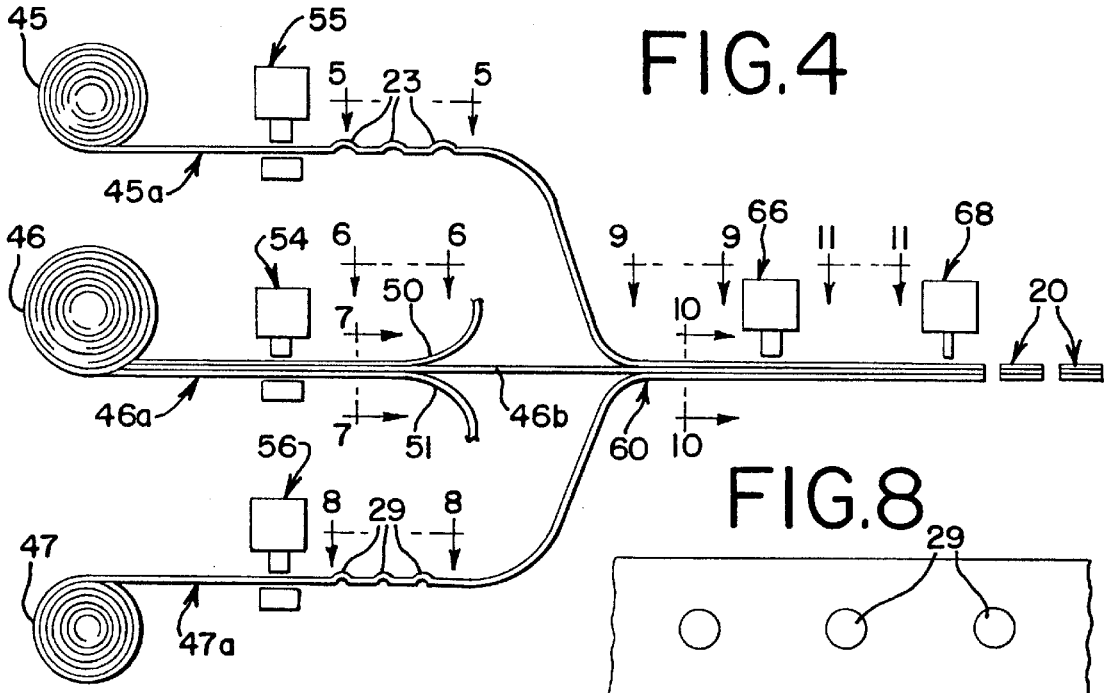
FIG. 4 is a diagrammatic view of a machine line for mass producing the switch of FIGS. 1 to 3 from reels of flat material.
Figure 8:
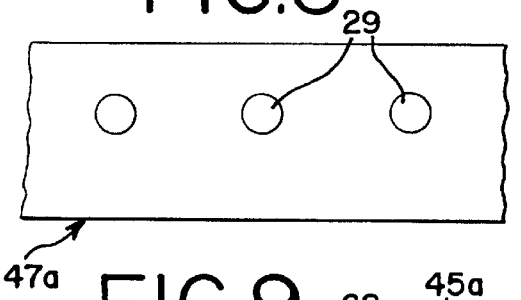
FIG. 8 is a top plan view of the lower metal web taken substantially along line 8—8 of FIG. 4 the contact profiles have been formed.
Figure 5:
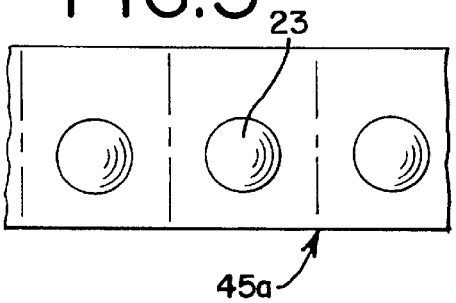
FIG. 5 is a top plan view of the upper metal web taken along line 5—5 of FIG. 4 after dome profiles are formed.

Referring now to FIG. 4, a machine line is illustrated for making the low profile tactile switch of FIGS. 1 to 3. In general, the machine line encompasses three reels or spools of raw material at the input end, feeding means for incrementally advancing the raw material, punch press type devices for forming the raw material, a bending device for bending the lead means of the switch, guide means for guiding the raw material, and cutting means for cutting the finished strip into individual switches. Three reels of raw material, designated 45, 46 and 47, are supplied from the inlet end of the machine line, while switches 20 come off the outlet end of the machine line in finished form. The reels are suitably rotated, supported, and initially traction feed holes along the opposed edges of the flat material are formed in a manner illustrated with respect to the second embodiment and explained below in connection with FIGS. 15 to 17. Suitable feed means at any desirable one or more locations along the feed line engage the traction holes to incrementally advance the raw materials in accordance with a programmed setup and in synchronism with the operation of the machines at the various work stations that perform operations on the raw materials.

The upper reel 45 provides the material to be formed into the upper conductive member or layer 22, while the lowermost reel 47 provides the flat material to be formed into the lower conductive member or layer 28. Accordingly, these reels may comprise the stainless web or strip to be formed to define the upper and lower conductive members.

Figure 6:
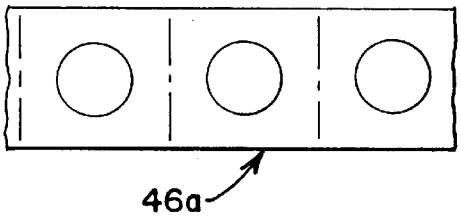
FIG. 6 is a top plan view of the insulating strip taken substantially along line 6—6 of FIG. 4 after cutouts or openings are formed.

The central reel 46 provides the flat material to be made into the insulating member 34 which would include the film 35 having pressure-sensitive adhesive on both sides and protected by upper and lower backup strips or release layers 50 and 51 that are peeled away from the film following the formation of the cutout or opening 36 at the cutout station 54. Thus, suitable backup strip peeling devices would be provided immediately after the cutout station 54 to remove the backup strips prior to further feeding of the insulating film along the machine line. The device or machine at the cutout station may comprise a punch press with suitable dies to form the cutout 36 or other suitable equipment such as a laser cutter if that would be practical. The laminated raw material coming from the reel 46 is designated 46*a* which would include the insulating film having pressure-sensitive adhesive on both sides and backup strips that are made of a suitable material easily releasable from the adhesive during the peeling of the strips, as shown in FIG. 6. As above mentioned, the insulating film may be of a polyester, a polyimide or other suitable material having good electrical insulating capabilities.

The upper reel 45 provides a flat material 45*a* which, after being formed to be receptive to the feed means, is incrementally fed to the dome-forming station 55 which may be in the form of a suitable punch press having dies capable of forming the dome profile 23. At the time the dome profile is being formed, the flat strip or web 47*a* being fed from the lower reel 47 is subjected to a forming operation at the contact forming station 56, where the smaller dome 29 is formed by a suitable punch press having suitable dies. The punch press for the lower web may be omitted where it is not necessary to include a smaller dome or dimple.

Figure 9:
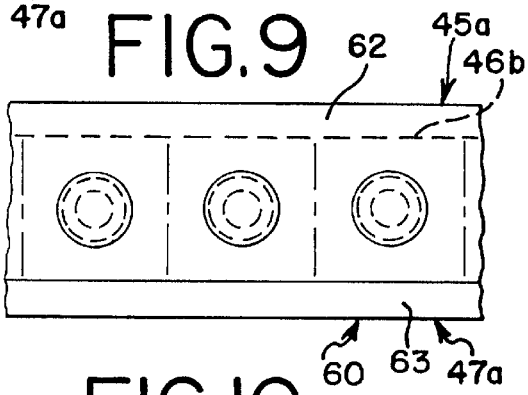
FIG. 9 is a top plan view taken substantially along line 9—9 of FIG. 4 showing the assembled upper and lower webs and the insulating strip.

Thereafter, suitable guides bring the upper and lower webs 45*a* and 47*a* together on the insulating film web 46*b* such as to align the dome profile 23 with the contact profile 29 and the cutout 36, as shown by the strip 60 in FIG. 9. It will further be appreciated that the dome profiles 23 are formed in the strip 45*a* in offset relation as are the contact domes 29 in the strip 47*a* so that when the strips 45*a*, 47*a* and the strip 46*b* are brought together, as shown in FIG. 9, sufficient metal is provided at opposite sides of the strip for formation of the leads 24 and 30.

Figure 10:
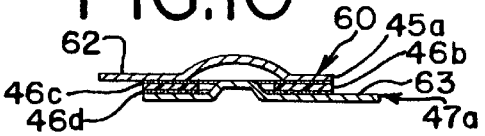
FIG. 10 is a transverse sectional view of the assembled webs and insulating strip taken substantially along line 10—10 of FIG. 4.
Figure 7:
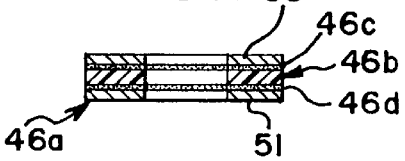
FIG. 7 is a transverse sectional view taken through the insulator strip of FIG. 4 substantially along line 7—7 thereof and also taken through a cutout or opening punched through the strip prior to peeling the backup strips or release layers from the insulating film.
Figure 11:
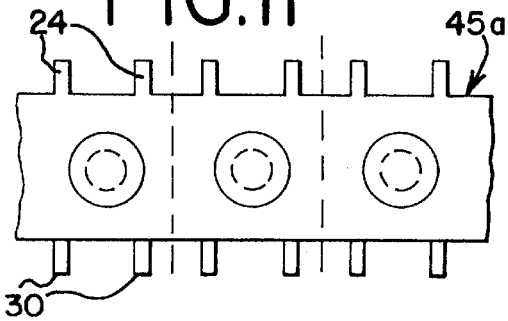
FIG. 11 is a top plan view of the assembled webs and insulating strip following the formation of the leads and taken substantially along line 11—11 of FIG. 4.

The formation of the product at this stage is the laminated strip 60, including the upper and lower conductive members and the intermediate insulating member, as shown in both FIGS. 9 and 10. Further, this strip assembly includes a margin 62 along the upper conductive strip 45*a* for making the leads for the upper conductive member and a marginal portion 63 extending from the lower strip 47*a* for making the leads of the lower conductive member. As seen particularly in FIGS. 7 and 10, the insulating film 46*b* includes a pressure-sensitive adhesive layer 46*c* on the upper surface and the pressure-sensitive adhesive layer 46*d* on the lower surface.

The laminated strip 60 is then incrementally fed to the lead-forming work station 66 which forms the leads 24 in the upper conductive strip 45*a* and the leads 30 in the lower conductive member. Next, the strip is incrementally fed through a lead-bending station to bend the leads downwardly, as illustrated in FIGS. 1 to 3. Following the lead-bending operation, the strip is incrementally fed through the cutoff work station 68 that cuts the strip to form the individual switches 20. Other suitable work stations may be included to form and/or cut the strip to provide a custom designed switch or array. Thus, it can be appreciated that the switches 20 may be mass produced along a machine line by feeding raw materials from reels of unfinished flat material which facilitates the economical manufacture of the switches.

Figure 12:
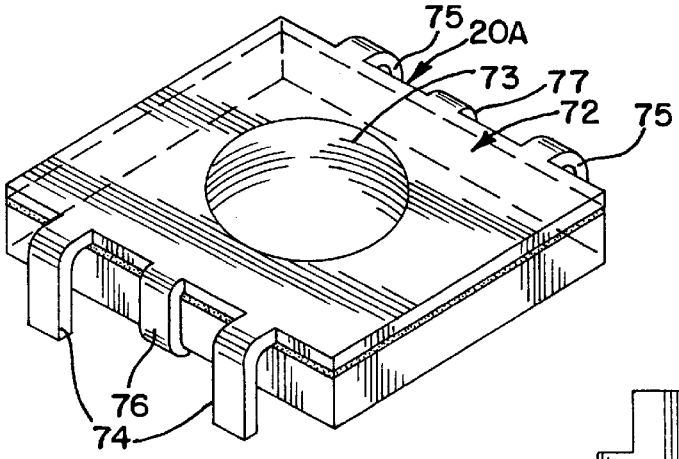
FIG. 12 is a perspective view of a modified low profile tactile switch of the present invention.
Figure 13:
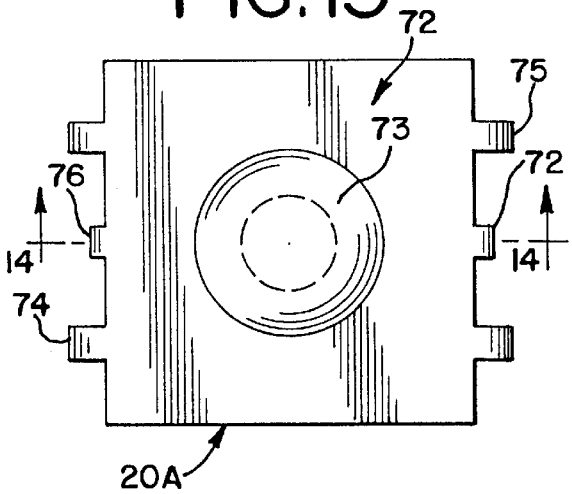
FIG. 13 is a top plan view of the switch of FIG. 12.
Figure 14:
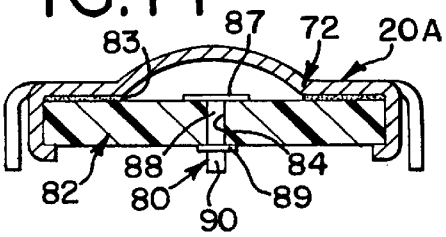
FIG. 14 is a transverse sectional view of the switch of FIG. 12 taken substantially along line 14—14 of FIG. 13.

Another switch embodiment of the invention is disclosed in FIGS. 12 to 14, which differs from the embodiment of FIGS. 1 to 3 in that a contact pin is provided in place of the lower conductive member. Further, use of the contact pin eliminates the need to form a large opening in the insulating member and to specially form the lower conductive member. Also, it is not necessary to include a pressure-sensitive adhesive layer on the underside of the insulating member.

This embodiment is generally designated by the numeral 20A and includes an upper conductive member 72 having a dome profile 73, lead means in the form of leads 74 and 75 and locking or retaining tabs 76 and 77. Thus, the upper conductive member is connected to one-half of the circuit.

The other half of the circuit is connected to the contact pin 80 which is mounted in the insulating member 82.

The insulating member 82 may be of any suitable film of insulating material such as above referred to and may be of a thickness greater than the thickness of the insulating member 35, such as about 5 mil (0.13 mm). However, the insulating member 82 is only provided with a pressure-sensitive adhesive layer on the upper side in the form of the adhesive layer 83. Further, the insulating member 82, which electrically insulates the upper conductive member 72 from the contact pin 80, is provided with a centrally disposed hole 84 into which the contact pin is inserted and mounted. The pin 80 may be made by any suitable inexpensive method.

The contact pin 80 includes a relatively flat head 87 that rests on the top surface of the insulating member 82. Extending from the head 87 is a shank 88 that is received in the hole 84 of the insulating member. Further, a retaining shoulder 89 is provided on the shank in spaced relation from the head 87 for engaging the underside of the insulating member 82 to retain the contact pin in mounted relation on the insulating member. Extending beneath the insulating member is a lead 90 that facilitates connection of the contact member into the other half of the circuit.

As seen in FIGS. 12 to 14, the leads 74 and 75 are integral with the upper conductive member and extend from the opposite edges of the conductive member and downwardly at about right angles to the conductive member so that they can be inserted into suitable openings on a printed circuit board when mounting the switch. The length of the leads may vary depending upon the needs for a particular installation. Moreover, shoulders could be provided on these leads to function as a standoff to a circuit board. Similarly, the length of the lead 90 of the contact pin may vary according to a particular installation. It may also be noted in FIGS. 12 to 14 that the locking tabs 76 and 77 are integral with the upper conductive member and are bent down over the opposite edges of the insulating member and preferably crimped on the underside of the insulating member to positively additionally lock the conductive member and the insulating member together even though the insulating member is connected by the pressure-sensitive adhesive layer 83 on the upper side of the insulating member.

The low profile tactile switch 20A is made similarly to the method of making the switch of FIGS. 1 to 3 in that raw materials are provided at the inlet end of a machine line to be formed and processed and which results in a finished switch that can be taken off the outlet end of the machine line. Additionally, contact pins can be inexpensively and easily made and thereafter insertably mounted on the insulating member during the movement of the insulating member along the machine line.

As seen in FIG. 15, a web of flat metal 93 is fed from a reel 94 and processible for making the upper conductive member of the switch 20A. An insulating member strip 95 is fed from a reel 96 for making the insulator of the switch. The insulator web 95 includes the insulating film 82 with the pressure-sensitive adhesive on the upper surface and covered by a backup strip or release layer 97.

With reference to both FIGS. 15 and 16, the metal web 93 is incrementally fed along the line and at the station No. 1, designated as 101. Feed holes 102 are suitably formed by a punch press having a set of dies and so that a standard feed mechanism can be employed for thereafter precisely feeding the web 93 through successive stations for successive operations. The dome profile 73 is formed by the No. 2 station 103, after which the web is fed to the No. 3 station 104, where metal is cut away from the strip, as seen in the No. 3 location in FIG. 16, to define the legs 74*a* that become the leads 74, legs 75*a* that become the leads 75, and legs 76*a* and 77*a* that become the locking tabs 76 and 77. While the web 93 is going through the stations 1, 2 and 3, the insulator web 95 is likewise going through stations 1, 2 and 3. At station 1, designated as 106, feed holes 107 are formed by a suitable device such as a punch press having a set of dies. Thereafter, a standard feeding device can incrementally and precisely feed the strip along the machine line. At station 2, identified as 108, the contact member hole 84 and opposed processing openings 109 and 110 are formed for defining the width of the insulating film to match the width of the upper conductive member. Following the punching of the openings at station 2, the backup strip 97 is peeled away from the insulating member which continues through the assembly line for further processing.

A suitable feed and insertion machine 112 is provided at station No. 3 for mounting contact members 80 in the holes 84 previously formed in the strip.

Following the operations at the No. 3 stations of the upper line and the lower line, the webs are joined together at a junction 115 in registry and thereafter processed together until the switch is completely made. It will be appreciated that no further forming operations are provided on the insulator web at the additional stations which bend the leads and crimp the retaining tabs before severing the laminated strip to define the individual switches. At station No. 4, indicated at 117, a suitable punch press or like machine not only bends the leads into the form shown in FIGS. 12 to 14 but also bends the locking tabs 76 and 77 downwardly and about the insulating member so that the tabs are crimped onto the insulating member, as particularly shown in FIG. 14. Finally, at No. 5 station, indicated as 120, and constituting a cutting station, the switches are cut out of the web and thereafter suitably packaged as individual switches.

It therefore can be appreciated that the method of making the low profile switch of FIGS. 12 to 14 in a mass-produced fashion is accomplished by putting the raw materials into the machine line at the beginning of the line and processing the raw materials to ultimately produce the switch 20A.

Figure 18:
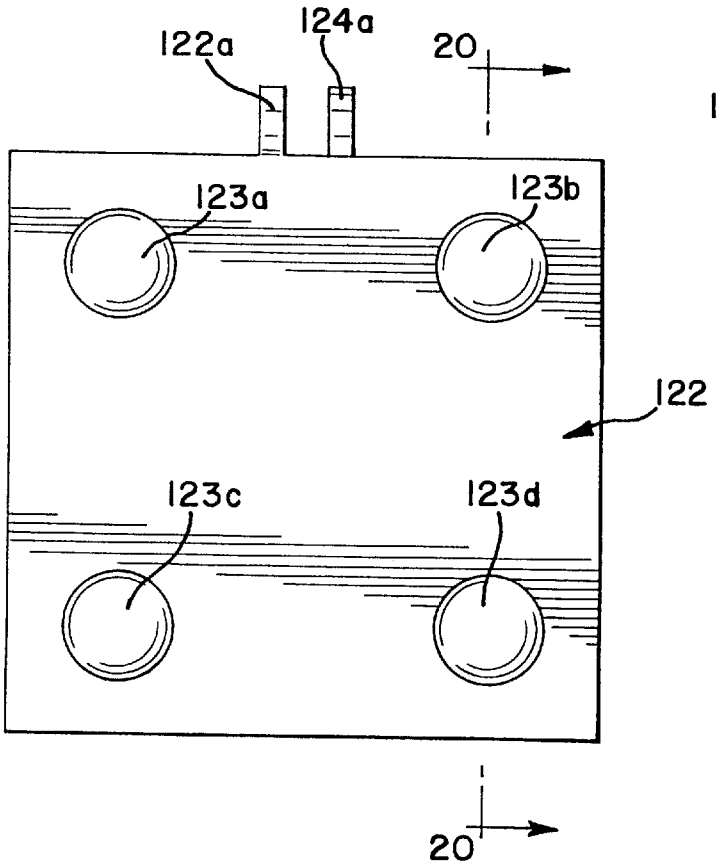
FIG. 18 is a plan view of another embodiment providing an array of dome switches for a single circuit wherein actuation of any one switch would close the circuit.
Figure 19:
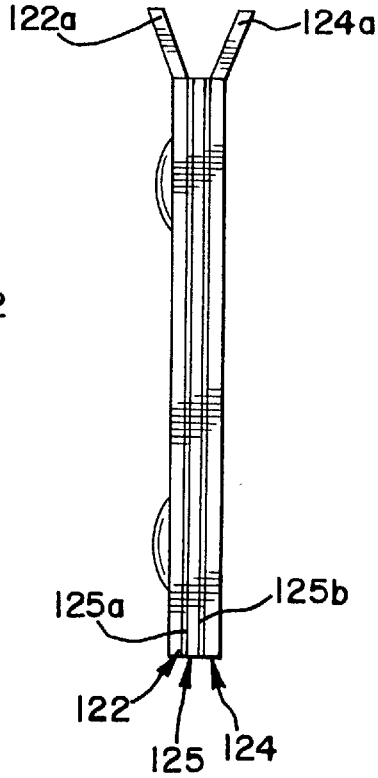
FIG. 19 is an end view of the switch array of FIG. 18.
Figure 20:
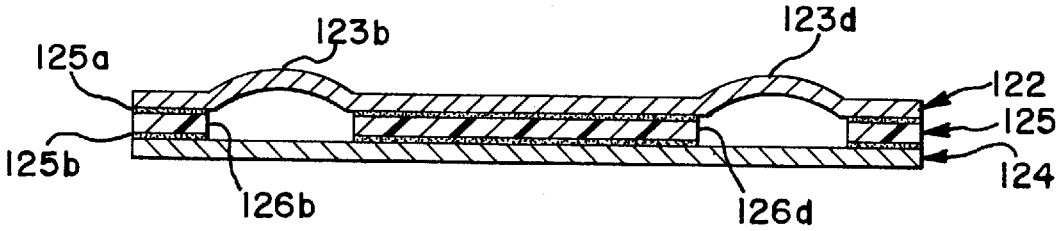
FIG. 20 is a vertical sectional view taken substantially along line 20—20 of FIG. 18.

Referring now to the embodiment of FIGS. 18 to 20, a double-sided tactile switch array with multiple domes controlling a single circuit is illustrated, which generally includes an upper layer 122 of suitable conductive metal having domes 123*a*, 123*b*, 123*c* and 123*d* formed therein, a lower layer of metal 124, and an insulator 125 having adhesive layers 125*a* and 125*b* on opposite sides thereof. Terminals or leads 122*a* and 124*a* are respectively formed along one edge of the upper and lower layers 122 and 124 to facilitate connecting into a circuit. These leads are slightly bent outwardly for separating them and facilitating connection in a circuit. The insulator 125 is formed with cutouts in alignment with the domes as shown by the cutouts 126*b* and 126*d* in FIG. 20. It will be appreciated that since the domes 123*a*–*d* are formed in the upper layer 122, they are electrically in common and form one contact of each of the respective dome switches. The other contact of each of the dome switches is that opposed portion of the lower layer 124 as seen in FIG. 20. Similarly, the opposed portions are electrically in common. Thus, depressing of any one of the domes to engage the opposed contact closes the switch for the array.

While the upper and lower layers of this array are shown to be square, they may take any suitable polygonal shape as desired for a particular use. This switch array would be used for controlling a single circuit where the actuating member operating the switch is of a relatively large size and switch closure is desired by depressing the actuating member at various spots. For example, this array could be useful in the steering wheel of a vehicle for closing a horn circuit where the actuator would have a relatively large area, and it would be desired that depressing anywhere on the area would cause energization of the horn. Further, while the dome formations are shown to be equally spaced apart and symmetrically positioned on the upper layer, they may be spaced apart in any desired fashion and located wherever desired. Although the domes are shown to be in a relatively square pattern, they may be in a circular or any other type of polygonal pattern if desired. Similarly, the terminals may be positioned anywhere along the peripheries of the upper and lower conductive layers.

The thickness of the conductive upper and lower layers may be the same or different depending upon the application, even though they are illustrated as being equal in thickness in the drawings. As mentioned previously with respect to the single dome switches, the thickness of the upper and lower layers may be anywhere from about 0.002 to 0.010 inch (0.05 mm to 0.25 mm). It should be appreciated that the thickness of the upper layer with the domes must be such as to withstand collapse and return of the dome which constitutes a snapover to engage the contact of the lower layer and return giving tactile feedback. Therefore, it should be appreciated that the lower layer may be thinner than the upper layer if desired since it is stationary. As in an environment where the switch would be used, the lower layer would be supported by a suitable support surface. The thickness of the insulator when using a polymer film with adhesive layers on opposite sides may be about 0.005 to 0.007 inch (0.13 mm to 0.18 mm). A 0.005 inch (0.13 mm) thickness insulator would usually include a 0.001 inch (0.025 mm) polymer film with about 0.002 inch (0.05 mm) pressure-sensitive adhesive on each side. Any suitable pressure-sensitive adhesive such as that which can be obtained from 3M or Tekra Corp. may be used. Where the insulator constitutes only pressure-sensitive adhesive and no polymer film, it may be about 0.002 to 0.012 inch (0.05 mm to 0.3 mm) thickness. Another type of adhesive that may be used would be what is known in the industry as a pad-printed adhesive and which can be obtained from Clifton Adhesives. The pad-printed adhesive thickness is approximately 0.001 to 0.003 inch (0.025 mm to 0.076 mm) thick. The polymer films may be a polyester, a polyimide, or any other suitable polymer.

The single circuit array switch of FIGS. 18 to 20 would be made by the same process described above with respect to the making of the switch of FIGS. 1 to 3. Thus, the upper and lower layers of conductive material are formed from a coil or spool of material that is fed through suitable dies in order to form the layers to the desired shape. It will be understood that a die forming the domes would have a configuration that would form all of the domes into the upper layer at the same time. Similarly, the die that processes the insulator would punch out four holes at the same time. Then the upper and lower layers would be brought together with the insulator in the middle to cause joining of the upper and lower layers to the insulator. Thereafter, the strip of layers would be die-cut to form not only the terminals but also the ultimate shape of a single array of dome switches for a single circuit, as shown in FIGS. 18 to 20. Also, the terminals would be bent as desired. As previously mentioned, the overall shape of the final configuration with respect to the location and number of domes and the outer peripheral contour of the array will be determined by the application for the switch.

Another embodiment of the invention is disclosed in FIGS. 21 to 26, which is a tactile switch array uniquely fabricated to allow the control of multiple circuits such as in a keypad. The switch array in its completed form is illustrated in FIGS. 22 to 25 and, for purposes of understanding, in exploded form in FIG. 26 and in an intermediate form in FIG. 21 prior to punching out the webs, as will be more clearly explained below. The switch as a whole is designated by the numeral 130 and includes an upper layer 131 of conductive material, a lower layer 132 of conductive material, and an insulator 133 therebetween. By separating the domes formed in the top layer into rows and the contact surfaces formed in the bottom layer into rows, control of multiple circuits can be achieved.

Figure 21:
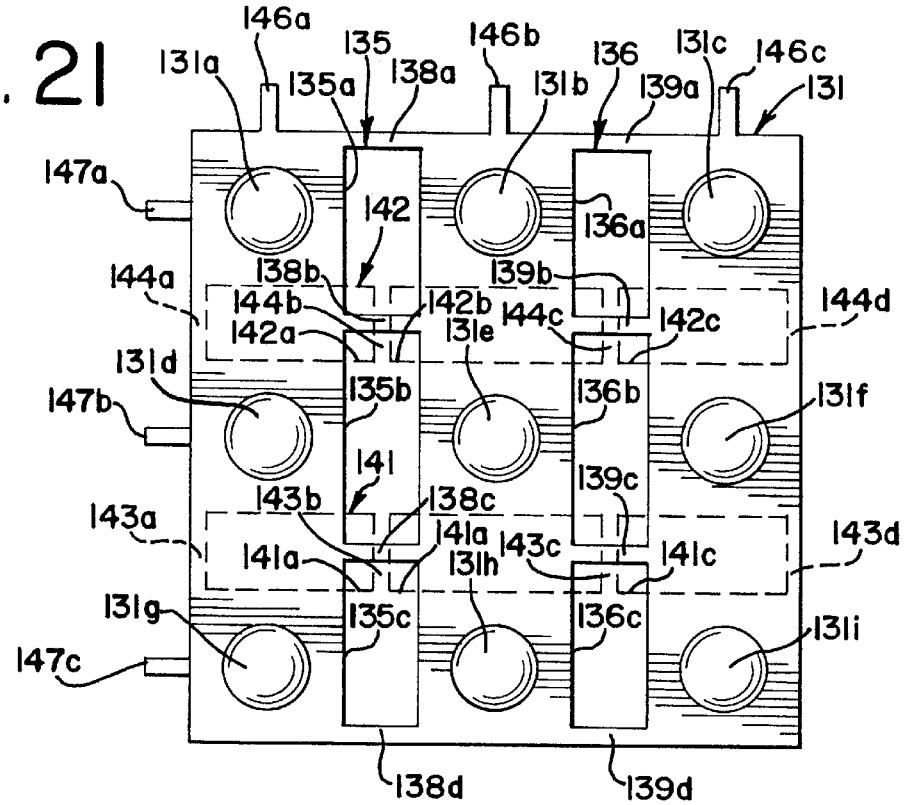
FIG. 21 is a top plan view of another embodiment providing an array of switches in an intermediate form prior to the removal of the webs that define individual switches for multiple circuits.
Figure 22:
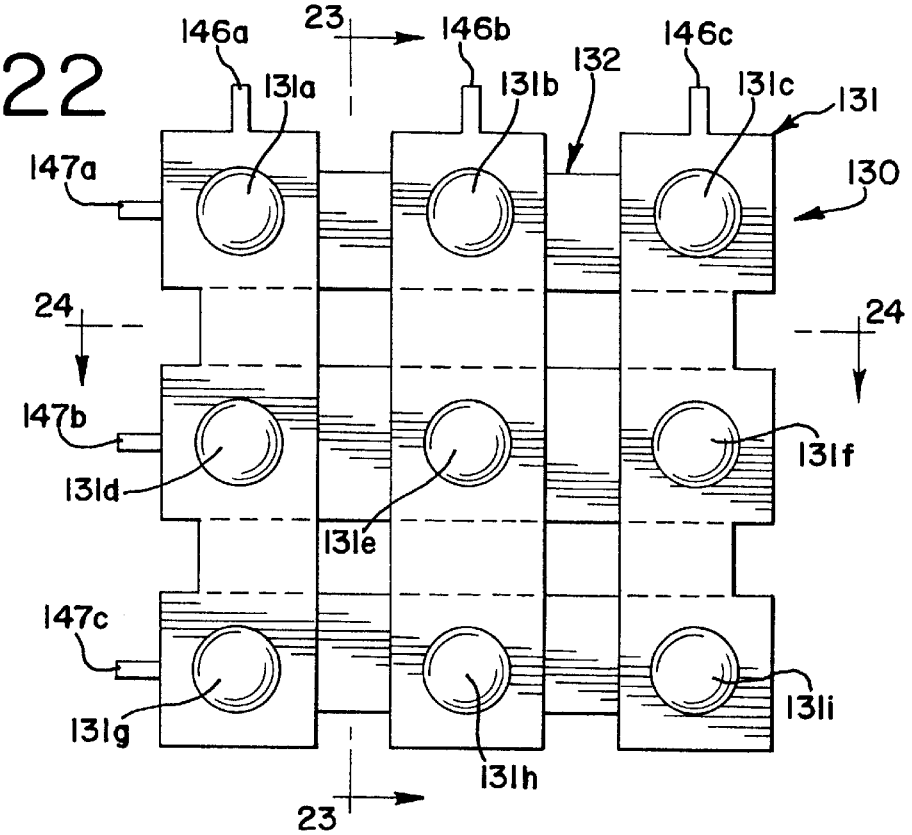
FIG. 22 is a top plan view of an array of switches shown in FIG. 21 for use with a plurality of circuits wherein each switch operates a single circuit where the webs shown in FIG. 21 are punched out.
Figure 23:
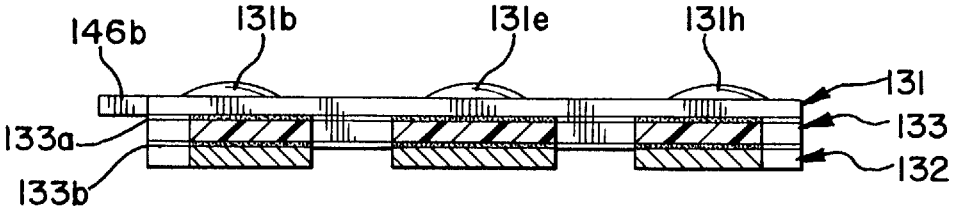
FIG. 23 Is a sectional view taken substantially along line 23—23 of FIG. 22.
Figure 24:
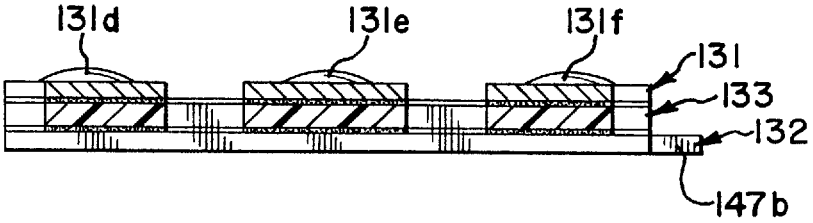
FIG. 24 is a sectional view taken substantially along line 24—24 of FIG. 22.
Figure 25:
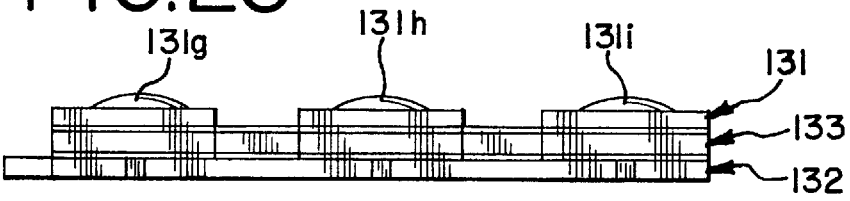
FIG. 25 is a front elevational view of the array of FIG. 22.
Figure 26:
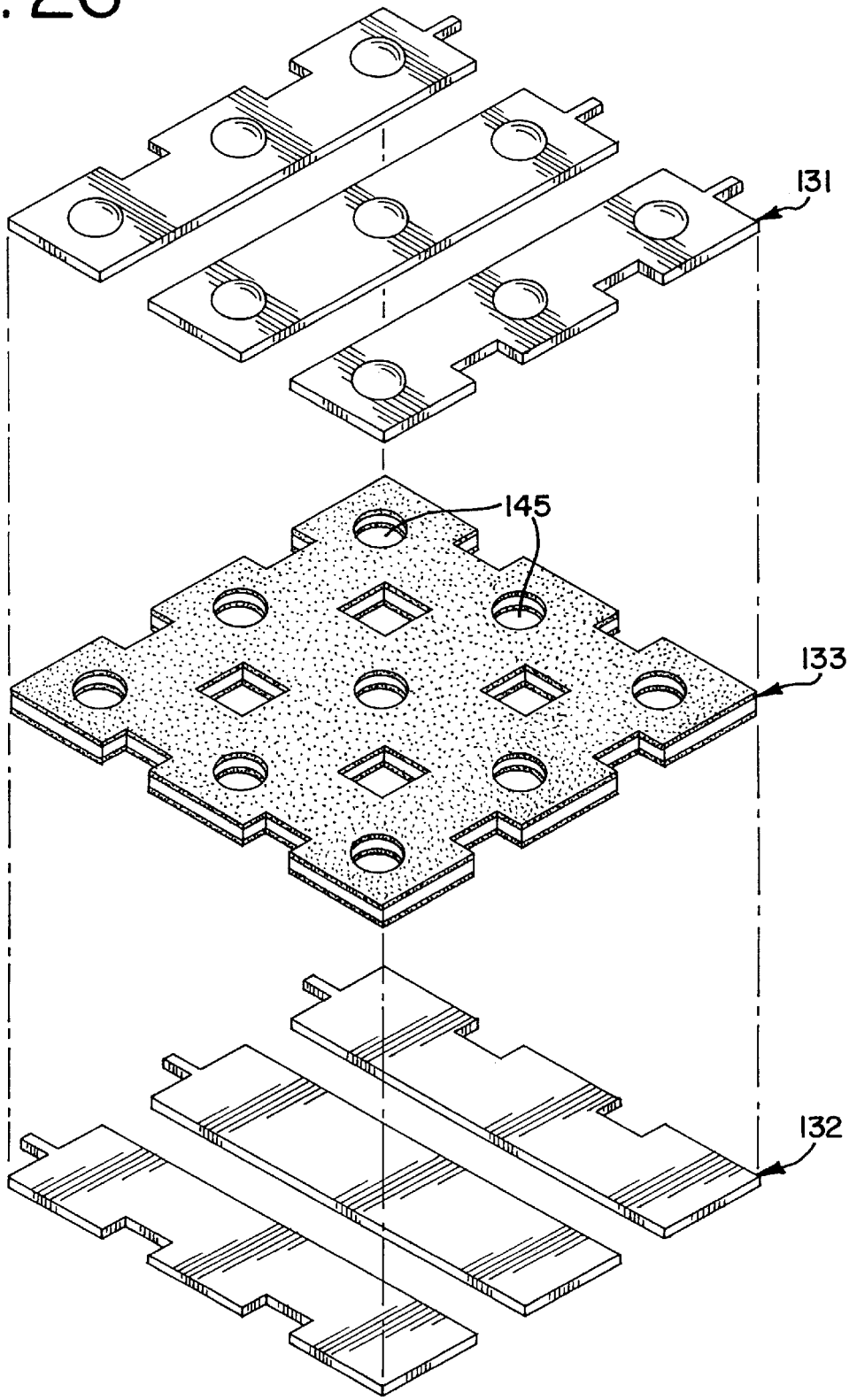
FIG. 26 is an exploded view of the switch array of FIG. 22 for purposes of clarity.

Except that the top layer includes domes 131*a*, 131*b*, 131*c*, 131*d*, 131*e*, 131*f*, 131*g*, 131*h* and 131*i*, it is formed identically to the lower layer 132, although when assembled with the insulator 133, the two layers are oriented 90 degrees to each other. Prior to the lamination of the top and bottom layers to the insulator, the layers are perforated or provided with cutouts so that later in the formation of the completed switch array multiple circuits can be provided. As seen in FIG. 21, the perforations are formed in each layer in two rows with three perforations per row, thereby defining three rows or strips of domes, where the domes in each row are electrically in common. This number would depend upon the total number of switches desired in the array, and the number illustrated accommodates a total number of nine individual switches. The upper layer 131, in addition to including the domes 131*a–i*, includes rows 135 and 136 of cutouts or perforations. The cutouts as illustrated are rectangular in form and row 135 includes cutouts 135*a*, 135*b* and 135*c*, while row 136 includes cutouts 136*a*, 136*b* and 136*c*. The row of cutouts 135 extends between the row of domes 131*a*, 131*d* and 131*g*, and the row of domes 131*b*, 131*e* and 131*h*. The row of cutouts 136 is arranged between the row of domes 131*b*, 131*e* and 131*h*, and the row of domes 131*c*, 131*f* and 131*i*. Further, the row of cutouts 135 defines webs 138*a*, 138*b*, 138*c* and 138*d* which extend between the rows of domes 131*a*, 131*d*, 131*g* and 131*b*, 131*e* and 131*h*. Similarly, webs 139*a*, 139*b*, 139*c* and 139*d* extend between the rows of domes 131*b*, 131*e*, 131*h* and 131*c*, 131*f* and 131*i*.

With respect to the bottom layer of conductive material 132, which forms the opposed contacts for the domes of the top layer, similar rows of cutouts 141 and 142, which respectively include cutouts 141*a*, 141*b* and 141*c* and 142*a*, 142*b* and 142*c*, respectively define webs 143*a*, 143*b*, 143*c*, 143*d* and 144*a*, 144*b*, 144*c*, 144*d*. As noted particularly in FIG. 21, the rows of cutouts 141 and 142 extend at right angles to the rows of cutouts 135 and 1 36 in the top layer. The cutouts 141 when viewed in relation to the domes are disposed between transversely arranged rows of domes 131*g*, 131*h*, 131*i* and 131*d*, 131*e*, 131*f*, while cutouts 142 are disposed between transversely arranged rows of domes 131*d*, 131*e*, 131*f*, and 131*a*, 131*b*, 131*c*.

With respect to the insulator 133, it is formed only with punched out holes 145 in alignment with the domes so as to allow engagement of the domes of the upper layer with the contacts of the lower layer in a like fashion to the embodiment of FIGS. 18 to 20.

Terminals or leads 146*a*, 146*b* and 146*c* are formed along one edge of the upper layer in alignment with the three rows of domes, while terminals or leads 147*a*, 147*b* and 147*c* are formed along one edge of the bottom layer in alignment with the areas extending between the rows of cutouts. It will be appreciated that the insulator 133 will be of a similar type hereinabove described wherein it would include a pressure-sensitive adhesive on the top and bottom sides of a polymer film so that when the upper and lower conductive layers are brought together with the insulator they will bond together in an assembled form. As previously mentioned, the insulator is preferably in the form of a polymer film with pressure-sensitive adhesive on opposite sides, but it may take the form of pressure-sensitive adhesive by itself in the thickness of about 0.002 to 0.012 inch (0.05 mm to 0.3 mm).

Following the lamination of the upper and lower layers of conductive material to the insulator, the webs of the upper and lower layers are punched out, as illustrated in FIGS. 22 to 26, thereby isolating each of the dome switches so that they may control multiple circuits. More specifically, the dome 131*a* would be connected into a circuit between terminals 146*a* and 147*a*, and similarly dome 131*b* to terminals 147*a* and 146*b*, dome 131*c* to terminals 147*a* and 146*c*, dome 131*d* to terminals 146*a* and 147*b*, dome 131*e* to terminals 146*b* and 147*b*, dome 131*f* to terminals 146*c* and 147*b*, dome 131*g* to terminals 146*a* and 147*c*, dome 131*h* to terminals 146*b* and 147*c*, and dome 131*i* to terminals 146*c* and 147*c*.

It will be appreciated that by forming several webs on the upper and lower conductive layers the automated manufacturing process will be facilitated, after which the webs can be removed to complete the separation of the switches to control multiple circuits. While the leads or terminals are shown to be in the form of short strips, it can be appreciated that they may be formed in any suitable size and shape for a particular application. It should further be appreciated that the top and bottom conductive layers and the insulating layer would be formed from strips or webs of material, and thereafter punched with cutouts and holes before being assembled together. Thereafter, the webs can be removed to isolate the individual switches for controlling individual circuits. Also, the terminals or leads can be formed by suitable dies. Any number of dome switches may be provided in an array depending upon the application. Moreover, their spacing and location may be varied according to the application desired. Similarly, the thicknesses of the upper and lower layers as well as the insulating layer may be chosen for a particular application.

From the foregoing, it will be appreciated that the low profile tactile switch of the present invention is unique and may be made by a unique manufacturing process in single or array form and which will provide a switch or array of switches to have the maximum dependability for operation while being formed at the lowest possible cost.

It will be understood that modifications and variations may be effected without departing from the scope of the novel concepts of the present invention, but it is understood that this application is to be limited only by the scope of the appended claims.

The invention is hereby claimed as follows:

1. A low profile switch comprising:

a conductive tactile member formed from a thin metal strip and being self-supporting, a conductive contact member, and an insulator between said members, said tactile conductive member having a collapsible tactile portion, said contact member having a contact portion engageable by said collapsible tactile portion when it is forced to collapse, said insulator being formed from a thin plastic film having a layer of pressure-sensitive adhesive on at least one side for adhesively connecting said film to said tactile conductive member, said contact member being carried by the insulator which electrically insulates the contact member from the tactile conductive member, and lead means for said tactile conductive member and said contact member for connection of the switch into a circuit, whereby application of a tripping force to said collapsible tactile portion of said tactile conductive member causes the collapsible tactile portion to collapse and contact said contact member to close the circuit, and release of the tripping force allows the collapsible tactile portion to return to its normal state and open the circuit.

2. The switch of claim 1, wherein said plastic film further includes a layer of pressure-sensitive adhesive on the other side for adhesively connecting to said contact member.

3. The switch of claim 2, wherein said contact member is in the form of a plate having the contact portion disposed in opposed relation to said tactile conductive member.

4. The switch of claim 3, wherein an opening is formed in said plastic film through which the tactile conductive member can pass to engage the contact portion of said plate.

5. The switch of claim 4, wherein the contact portion projects from said plate towards said collapsible tactile member and into said opening.

6. The switch of claim 1, wherein said tactile conductive member has a thickness of about 0.002 to 0.010 inch, and said insulator has a thickness of about 0.002 to 0.012 inch.

7. The switch of claim 6, wherein said contact member is in the form of a plate having a thickness of about 0.002 to 0.020 inch.

8. The switch of claim 1, wherein said collapsible tactile portion is dome-shaped.

9. The switch of claim 1, wherein said contact member is in the form of a pin having a head on one end defining the contact portion.

10. The switch of claim 9, wherein said pin further includes a shoulder spaced from said head and coacting with the head to retain the pin in a hole formed in the insulator.

11. The switch of claim 1, wherein said plastic film is a polymer.

12. The switch of claim 1, wherein said polymer is a polyester.

13. The switch of claim 1, wherein said polymer is a polycarbonate.

14. The switch of claim 1, wherein said polymer is a polyimide.

15. The switch of claim 1, wherein said conductive tactile member is dome-shaped.

16. The switch of claim 1, wherein said lead means includes leads extending from each of said members.

17. The switch of claim 1, which includes a plurality of conductive tactile members for controlling a single circuit.

18. The switch of claim 1, which includes a plurality of conductive tactile members for controlling a plurality of circuits.

19. A low profile tactile switch consisting essentially of:

a self-supporting movable contact formed from a thin conductive material and including a tactile portion, an insulator formed from thin plastic film, pressure sensitive adhesive on at least one of the movable contact or the insulator for adhesively connecting said insulator to said movable contact, and a stationary contact mounted on said insulator opposite from and contactable with said tactile portion and insulated from said movable contact.

20. The switch of claim 19, wherein the thickness of the movable contact is in the range of 0.002 to 0.010 inch.

21. The switch of claim 20, wherein the thickness of the insulator is in the range of 0.002 to 0.012 inch.

22. The switch of claim 19, which further includes leads extending from the contacts for connection in a circuit.

23. The switch of claim 22, which further includes tab means extending from said movable contact and grippingly engaging said insulator.

24. The switch of claim 19, wherein the plastic film is a polycarbonate.

25. The switch of claim 19, wherein the plastic film is a polyimide.

26. The switch of claim 19, wherein the stationary contact member is in the form of a planar plate.

27. The switch of claim 19, wherein the stationary contact member is in the form of a pin having a head on one end contactable with said movable contact.

28. A low profile tactile switch consisting essentially of:

a first self-supporting movable contact of thin conductive material including a tactile portion, a second stationary contact disposed in opposed relation to said tactile portion and being contactable thereby, and insulator means separating and electrically insulating the contacts from each other, said insulator means including adhesive means interconnecting said contacts.

29. The switch of claim 28, wherein the insulator means includes a layer of pressure-sensitive adhesive.

30. The switch of claim 28, wherein said insulator means includes a plastic film on which pressure-sensitive adhesive has been applied to at least one side.

31. The switch of claim 30, wherein pressure-sensitive adhesive has been applied to both sides of the film.

32. The switch of claim 28, wherein the insulator means includes a layer of pad-printed adhesive.

33. The method of making a low profile tactile switch consisting essentially of a first conductive contact member, a second conductive contact including a self-supporting conductive tactile member, and an insulator disposed between said members, said method comprising the steps of:

incrementally feeding a metal strip along one line to a punch press having a set of dies for stamping a dome formation in said metal strip to form the tactile member, incrementally feeding to a punch press having a set of dies to make the insulator for the switch an insulator strip along the same line and the insulator strip having a pressure-sensitive adhesive on at least one side, feeding the metal strip to join the adhesive side of the insulator strip along the same line, mounting a contact member to the insulator for engagement by said tactile member upon actuation thereof, and severing the metal strip and insulator to form the switch.

34. A method of making low profile tactile switches having a thin upper conductive member with a tactile dome and lead means, a thin lower conductive member having a contact and lead means wherein the contact opposes the tactile dome, and a thin insulating member between said conductive members with pressure-sensitive adhesive on both sides and an opening therethrough in alignment with said dome and contact, said method comprising the steps of:

incrementally feeding a first conductive metal strip to means forming tactile domes therein, incrementally feeding a second conductive metal strip to means forming contacts in the second strip, incrementally feeding a strip of electrical insulating material having pressure-sensitive adhesive on both sides covered with peelable release layers to means forming openings in the insulating material strip, peeling away the release layers from the insulating material, joining said first and second metal strips to opposite sides of the insulating material to form a switch strip wherein the domes and contacts align with each other and with the openings in the insulating material, incrementally feeding the switch strip to means forming leads on said first and second metal strips, and severing the switch strip between each aligned dome and contact to form individual switches.

35. The method of claim 34, wherein the means forming the tactile dome in the first strip includes a punch press having a set of dies.

36. The method of claim 35, wherein the means forming the contacts in the second strip includes a punch press having a set of dies.

37. The method of claim 36, wherein the means forming the openings in the insulating material strip includes a punch press having a set of dies.

38. A method of making low profile tactile switches having a thin upper conductive member with a tactile dome and lead means, a thin insulating member connected to the upper conductive member having a hole therethrough aligned with the dome, and a pin member mounted on said insulating member having a shank extending through the hole, a contact on one end of the shank engageable by said dome when it is collapsed, and lead means on the other end of the shank, said method comprising the steps of:

incrementally feeding a conductive strip to means forming tactile domes therein, incrementally feeding the conductive strip to means forming lead legs and locking tab legs adjacent the domes, incrementally feeding an insulating strip having pressure-sensitive adhesive on one side covered by a peelable release strip to means forming a pin hole for the contact pin, peeling away the release strip, incrementally feeding the insulating strip to means for inserting contact pins in said pin holes, incrementally feeding the conductive strip and insulating strip in joined registry with each other so that domes align with pins, incrementally feeding the joined strips to means bending the lead legs to leads extending substantially perpendicular to the plane of the strips and bending and crimping the locking tab legs about edges of the insulating strip from switches, and severing the switches from the strips to form individual switches.

* * * * *

UNITED STATES PATENT AND TRADEMARK OFFICE

CERTIFICATE OF CORRECTION

PATENT NO. : 5,828,016

DATED : October 27, 1998

INVENTOR(S) : Dennis A. Grannan and David W. Thompson

It is certified that error appears in the above-identified patent and that said Letters Patent is hereby corrected as shown below:

Column 3, line 8, change "atop" to -- a top--.
line 27, after "FIG. 4" insert --after--.

Signed and Sealed this

Second Day of March, 1999

*Attest:*

Q. TODD DICKINSON

*Attesting Officer*

*Acting Commissioner of Patents and Trademarks*